US009845678B2

(12) United States Patent
Skogseth et al.

(10) Patent No.: US 9,845,678 B2
(45) Date of Patent: Dec. 19, 2017

(54) LOCALLY ANCHORED SELF-DRILLING HOLLOW ROCK BOLT

(71) Applicant: Normet International Ltd., Surnadal (NO)

(72) Inventors: Trond Skogseth, Surnadal (NO); Francois Charette, North Bay (CA); Marcus Svanberg, Arvidsjaur (SE)

(73) Assignee: Normet International Ltd., Surndal (NO)

( * ) Notice: Subject to any disclaimer, the term of this patent is extended or adjusted under 35 U.S.C. 154(b) by 0 days.

(21) Appl. No.: 15/148,329

(22) Filed: May 6, 2016

(65) Prior Publication Data

US 2016/0326873 A1 Nov. 10, 2016

Related U.S. Application Data

(60) Provisional application No. 62/158,656, filed on May 8, 2015.

(51) Int. Cl.
*E21D 21/00* (2006.01)
*E21D 20/02* (2006.01)

(52) U.S. Cl.
CPC ..... *E21D 20/021* (2013.01); *E21D 21/008* (2013.01); *E21D 21/0033* (2013.01); *E21D 21/0053* (2016.01)

(58) Field of Classification Search
CPC ..... E21D 21/0046; E21D 21/0053
USPC ..... 405/259.1–262
See application file for complete search history.

(56) References Cited

U.S. PATENT DOCUMENTS 3,837,258 A * 9/1974 Williams ..... E21D 20/00 405/259.3
4,160,615 A * 7/1979 Baldwin ..... E21D 21/0026 405/259.3
4,431,348 A * 2/1984 Powondra ..... E01F 7/04 403/DIG. 8
4,704,053 A * 11/1987 Hipkins, Sr. ..... E21D 20/02 405/259.1

(Continued)

FOREIGN PATENT DOCUMENTS

AU 2003204831 A1 1/2004
CN 202117696 U 1/2012

(Continued)

*Primary Examiner* — Benjamin F Fiorello
*Assistant Examiner* — Edwin J Toledo-Duran
(74) *Attorney, Agent, or Firm* — Boyle Fredrickson, S.C.

(57) ABSTRACT

A locally-anchored, self-drilling, deformable, hollow rock bolt has one or more intermediate local anchors each of which is flanked by two relatively elongateable shank segments. After grout is supplied through the hollow interior of the rock bolt while the rock bolt is in the drilled borehole, each anchor fixes the bolt to the rock mass, whereas the adjacent smooth shank segments can deform and even yield to accommodate rock fracture. The local anchors may be of relatively short extent when compared to the shank segments. One or more of the intermediate anchors could be formed by a coupler connecting adjacent bolt sections together and/or by shaping the bolt and/or by providing an external anchor. The innermost end of the rock bolt may be formed from or bear a drill bit. The drill bit can have dual functions of drilling the borehole and serving as the innermost anchor of the bolt.

23 Claims, 8 Drawing Sheets

(56) References Cited

U.S. PATENT DOCUMENTS 4,798,501 A * 1/1989 Spies ..... E21D 21/0006 405/259.1
4,861,197 A * 8/1989 Calandra, Jr. ..... E21D 21/0026 405/259.3
4,938,631 A 7/1990 Maechtle et al.
4,954,017 A * 9/1990 Davis ..... E21D 21/004 405/259.3
5,042,961 A * 8/1991 Scott ..... E21D 21/008 405/259.4
5,052,861 A * 10/1991 Hipkins, Sr. ..... E21D 21/008 405/259.3
5,256,016 A * 10/1993 Godfrey ..... F16B 13/065 411/32
5,273,377 A 12/1993 Taylor
5,314,268 A * 5/1994 Calandra, Jr. ..... E21D 21/008 405/259.1
5,378,087 A * 1/1995 Locotos ..... E21D 11/006 405/259.5
5,387,060 A * 2/1995 Locotos ..... E21D 21/0026 405/259.3
5,433,558 A * 7/1995 Gray ..... E21D 21/0026 405/259.1
5,511,909 A * 4/1996 Calandra, Jr. ..... E04C 5/122 405/259.1
5,667,011 A * 9/1997 Gill ..... E21B 33/14 166/207
5,775,849 A * 7/1998 Sorkin ..... E04C 5/10 285/322
5,829,922 A * 11/1998 Calandra, Jr. ..... E21D 21/008 405/259.1
5,984,588 A 11/1999 Ferrari
6,012,874 A * 1/2000 Groneck ..... E02D 5/38 405/239
6,270,290 B1 * 8/2001 Stankus ..... E21D 20/025 405/259.1
6,447,228 B1 9/2002 Fergusson
6,652,195 B2 * 11/2003 Vickars ..... E02D 5/36 175/262
6,679,335 B2 * 1/2004 Slack ..... E21B 7/20 166/242.1
6,685,236 B2 * 2/2004 Setterberg, Jr. ..... E21B 17/08 166/207
7,037,046 B2 5/2006 Fergusson
7,896,580 B2 3/2011 Weaver et al.
8,142,109 B2 3/2012 Schmidt
8,337,120 B2 12/2012 Li
8,434,970 B2 5/2013 Gaudry et al.
8,851,802 B2 10/2014 Weaver et al.
8,899,883 B2 12/2014 Champaigne et al.
2003/0075338 A1 * 4/2003 Sivley, IV ..... B21D 41/02 166/380
2005/0156127 A1 7/2005 Fergusson
2006/0067795 A1 3/2006 Spearing et al.
2007/0183850 A1 8/2007 Hedrick
2010/0202838 A1 8/2010 Weaver et al.
2011/0103896 A1 * 5/2011 Horsch ..... E21B 10/42 405/259.1
2013/0028667 A1 1/2013 Champaigne et al.
2014/0020911 A1 * 1/2014 Martinez ..... E21B 23/01 166/387

FOREIGN PATENT DOCUMENTS

DE 35 04 543 C1 5/1986
DE 34 00 182 C2 7/1989
DE 37 17 024 C2 10/1989
DE 41 28 154 A1 8/1991
DE 44 45 626 A1 6/1996
DE 44 43 131 C2 7/2001
DE 100 52 306 C1 5/2002
DE 101 31 818 C1 2/2003
DE 42 20 636 B4 7/2004
DE 10 2009 056 089 A1 6/2011
EP 1 533 471 A1 5/2005
EP 2 094 944 B1 1/2010
EP 2 354 448 A2 8/2011
JP 02-210199 A 8/1990
WO 2004/106700 A1 12/2004
WO 2011/020144 A1 2/2011
WO 2011/149420 A1 12/2011
WO 2014/064653 A2 5/2014
WO 2015/003726 A1 1/2015

* cited by examiner

LOCALLY ANCHORED SELF-DRILLING HOLLOW ROCK BOLT

CROSS REFERENCE TO A RELATED APPLICATION

This application claims priority under 35 USC §1.119(e) to earlier U.S. Provisional Patent Application Ser. No. 62/158,656, filed May 8, 2015 and entitled LOCALLY ANCHORED SELF-DRILLING HOLLOW ROCK BOLT, the contents of which are incorporated by reference in their entirety.

BACKGROUND OF THE INVENTION

1. Field of the Invention

The invention generally relates to wall anchors and, more particularly, relates to self-drilling hollow "rock bolts" that are used to reinforce the rock walls of mine openings, tunnels, and the like. The invention additionally relates to methods of fabricating, assembling, and using such rock bolts.

2. Discussion of the Related Art

Mining and tunneling applications often require that the rocks forming the walls of the mine opening or tunnel be reinforced against both the dead weight of the rock, slow deformation and/or sudden bursting. Bolting is the most commonly-used technique for rock reinforcement in underground excavations. Millions of rock bolts are consumed worldwide every year. Basic demands of rock bolts are that they have to be able to bear not only a heavy load, but also must withstand a certain elongation before bolt failure. In highly-stressed rock masses, the rock reacts to excavation either in form of large deformation in weak rocks, or of rock bursting in hard rocks. In these situations, deformation-tolerable (or energy-absorbable) bolts are required in order to achieve good rock reinforcement and reduce the risk of rock fall. Particularly in the mining industry, this need for deformation-tolerable bolts is even stronger than in other rock branches since mining activities are getting deeper and deeper, and problems of rock deformation and rock burst are becoming increasingly severe as the depth increases.

Traditional rock bolts, however, did not provide a good combination of anchoring or load bearing ability and deformability. For example, fully grouted traditional rebar bolts offer very limited elongation (on the order of 30 mm) prior to failure. Traditional frictional bolts provide an unacceptably low load-bearing capacity for many applications, even though they exhibit high deformability.

More recently, a rock bolt has been developed that is locally anchored at one or more discrete locations and that is deformable between the anchors. This bolt, commercially available from Normet under the trade-name D-Bolt®, is disclosed in U.S. Pat. No. 8,337,120, the subject matter of which is hereby incorporated by reference in its entirety. The bolt includes a relatively smooth steel rod with a number of discrete integral anchors along its length. The bolt is anchored in a borehole with either cementitious grout or resin. The bolt is fixed within the surrounding grout primarily at the locations of the anchors, while the smooth sections between the anchors can freely deform when the bolt is subjected to rock dilation. The bolt absorbs the rock dilation energy through fully mobilizing the strength and deformation capacities of the bolt material, typically engineered steel. The smooth sections of a D-Bolt independently provide reinforcement functions to the rock, and failure of one section does not affect the reinforcement function of other sections of the bolt.

The D-Bolt rock bolt offers an excellent combination of deformability and load bearing capacity. However, it does exhibit some disadvantages in some applications.

For example, D-Bolt rock bolts and other rock bolts typically come in standard lengths, requiring that all boreholes be drilled to the same depth or, in the alternative, that different bolts of different, albeit still standard, lengths be kept on-hand to permit some versatility of reinforcement depth.

In addition, a D-Bolt typically must be grouted into a previously-drilled borehole in a three step procedure including borehole drilling, grout insertion, and rock bolt insertion. The grout typically is inserted into the borehole either by being injected directly into the borehole, or by inserting one or more grout-filled cartridges into the borehole. These cartridges are ruptured when the rock bolt is subsequently inserted into the borehole. In either event, the grout is intended to fill the space between the rock bolt and the inner peripheral surface of the borehole and, upon hardening, to lock the rock-bolt to the rock at the local anchors. However, if the rock is highly fractured, debris may form a barrier that prevents the grout from completely filling the gap between the rock bolt and the peripheral surface of the borehole. In addition, some grout takes the form of a two-part resin that must be mixed by rotation of the bolt. Debris in the borehole might hinder adequate resin mixing. In extreme situations, the borehole may effectively collapse upon removal of the drill, preventing subsequent insertion of the grout and/or the rock bolt into the borehole.

Self-drilling rock bolts are known that negate the need to drill the borehole with a separate tool before inserting the rock bolt, eliminating the risk of borehole collapse prior to rock bolt insertion and eliminating or reducing the other detrimental effects of borehole collapse around a rock bolt. The typical self-drilling bolt comes in the form of a hollow tube bearing a sacrificial drill bit at its inner end. The tube is of smaller diameter than the bit so that, upon being drilled into the substrate, a borehole is formed around the bolt. Grout then can be injected into the bolt from its outer end, whereupon the grout flows axially through the bolt, through one or more passages in or near the inner end of the bolt or the sacrificial drill bit, and outwardly between the bolt and the borehole wall to fill the gap.

However, existing self-drilling bolts, including existing self-drilling hollow rock bolts, like the other traditional rock bolts described above, lack local anchors between relatively elongateable bolt sections. Most self-drilling rock bolts instead are threaded or otherwise have relatively small anchors along their entire length and, thus, lack any sections that are more elongateable or, for that matter, offer greater anchoring ability than any other sections. Traditional self-drilling rock bolts thus do not provide an acceptable combination of local anchoring or load bearing ability and elongateability.

The need therefore exists to provide a hollow, self-drilling, locally anchored, elongateable rock-bolt.

The need still additionally exists to provide a hollow, locally anchored, self-drilling rock bolt that is of adjustable length, enhancing greater versatility of borehole depth without increasing inventory requirements.

The need additionally exists to provide a simplified process of installing a locally anchored, hollow, self-drilling rock bolt.

SUMMARY

In accordance with a first aspect of the invention, at least one of the above-identified needs is met by providing a hollow, self-drilling rock bolt with at least one intermediate local anchor which is flanked by two relatively deformable shank segments. The rock bolt is grouted to the borehole by grout supplied through the hollow interior of the rock bolt while the rock bolt is in the borehole. Each anchor fixes the bolt to the grout and to the rock mass, whereas the shank segments have a lower anchoring capacity than the local anchors. Looking at the situation another way, the shank segments are relatively "debondable" in comparison to the anchors in that they can slip more easily than the anchor. This ability to slip permits the shank segments to elongate and possibly even yield to accommodate rock fracture. The rock bolt has high capacity in both deformation and load-bearing, yet is self-drilling and can be grouted in place.

The innermost end of the rock bolt may be formed from or bear a drill bit. The drill bit can have dual functions of drilling the bore and serving as the innermost anchor of the bolt.

The local anchors may be of relatively short extent when compared to the shank segments. For example, the ratio of the aggregate axial length of the local anchors to the total length of the bolt may range from 1:2 to 1:50, and more typically of about 1:10 to 1:25. In one example, each intermediate local anchor is about 40 to 80 mm long, and each shank segment is about 500 to 2,500 mm long and more typically 900 to 1,900 mm long. In another example, each intermediate local anchor is about 40 to 80 mm long, and each shank segment is about 1,500 to 3,500 mm long and more typically 2,500 to 2,800 mm long.

Each local anchor may be configured to have an "anchoring" or "holding" force that exceeds the yield load of the rock bolt.

One or more of the shank segments may exhibit uniform debondability along substantially the entirety of its axial extent. For example the shank segments may be of smooth, possibly smooth cylindrical nature.

Alternatively, one or more of the shank segments may exhibit non-uniform debondability along its axial length so one or more portions that slip less easily than one or more other portions so as to provide limited anchoring but less anchoring than that provided by the local anchor(s). For example, a shank segment may have a first portion that is relatively smooth so as to have very high debondability and very low anchoring capacity and one or more portions that are threaded, knurled, bent into a waveform, or otherwise provided with or bear structures imbuing greater anchoring capacity and lower debondability in that portion than in the relatively smooth portion.

In order to provide versatility of bolt length, the bolt may include a tube formed in two or more sections or tubular bodies connected to one another, with each pair of adjacent sections being connected together by a coupler such as sleeve threaded onto or otherwise attached to the ends of the adjacent sections. In this case, each coupler forms an intermediate local anchor, and the sections of the tube between the sleeves or other local anchors form the shank segments.

Instead of being formed from a coupler, an intermediate local anchor could be formed by a section of the hollow bolt that is shaped such as by crimping or expansion. An external anchor also could be attached to the bolt. Any of these alternative anchors could be used alone or in combination with other forms of alternative anchors and/or with couplers.

In accordance with another aspect of the invention, a method of reinforcing a rock wall includes drilling a borehole into the wall with a self-drilling, hollow rock bolt having a drill bit on its inner end, then causing grout to flow through the hollow interior of the rock bolt and through one or more passages in the rock bolt and/or the sacrificial drill bit, and into the borehole. After the grout hardens, the rock bolt is locally anchored to the rock by the drill bit and at least one intermediate anchor located between the drill bit and the outer end of the rock bolt. The anchored bolt can deform by elongation and possibly even yield along a shank segment extending between the drill bit and the intermediate anchor.

The method may additionally include coupling at least tubular bodies together via a coupler prior to or between segments of the drilling operation. In this case, the coupler forms an intermediate local anchor after the grout hardens.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figure 1:
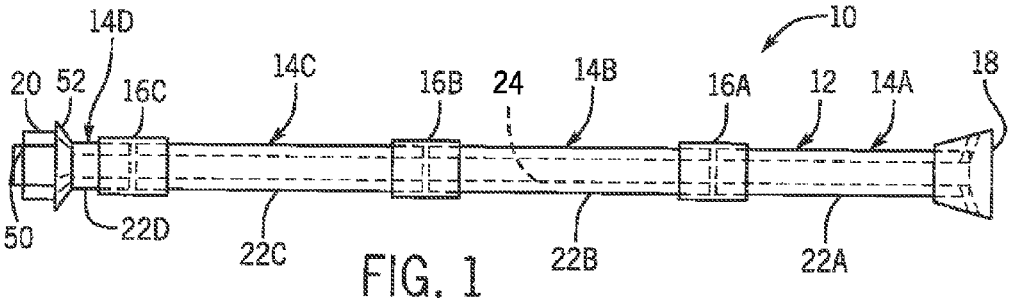
FIG. 1 is a somewhat schematic side view of a self-drilling, hollow, locally-anchored, deformable rock bolt constructed in accordance with an embodiment of the invention.

Various embodiments of hollow, self-drilling, locally anchored, deformable rock bolts will now be described. The bolts as described herein are designed to reinforce rock, most typically rock walls in underground mines and tunnels. They have high capacity in both deformation and load-bearing. The bolt is particularly-well suited to civil and mining engineering applications that face the problem of large rock deformation or rock burst. The bolt can provide good reinforcement not only in the case of continuous rock deformation (in soft and weak rock masses), but also in the case of local opening of individual rock joints (in blocky rock masses). The opening displacement of a single rock joint will be constrained by the two anchors overriding the joint.

Thus, rock bolts constructed in accordance with the invention have one or more local anchors each flanked by relatively elongateable shank segments. Each local anchor has higher anchoring or holding capacity than the adjacent shank segments. The shank segments may have a higher deformation (elongation) capacity per unit length than the anchors.

The shank segments are relatively debondable when compared to the anchors so as to capable of slipping relative to the hardened grout in the borehole. This slippage capability permits the shank segments to take up local elongation strain between pairs of anchors. When elongating under strain, each shank segment may slip relative to its local borehole perimeter by having a surface released relative to said hardened grout due to diameter reduction due to the so-called Poisson effect. Several techniques could be used to render the shank section relatively debondable when compared to the anchors.

For example, each shank segment could have a smooth, likely cylindrical surface. Each shank segment may be more or less finely ground or polished by techniques like chemical polishing or electropolishing. The surface may further be treated in such a way that the surface of the shank segment has no or negligibly low bonding to the hardened grout. One technique for achieving this goal is to coat the shank segment surface with a thin layer of wax, lacquer, paint or other non-adhesive or lubricant medium.

However, a shank segment need not necessarily be smooth, so long as it is relatively debondable when compared to the anchors. That debondability can be non-uniform along the length of the segment. For example, part or all of a shank segment could be threaded, knurled, roughened, bent into a waveform, or otherwise to provide limited anchoring that is of a lower holding capacity than that of the local anchors. Providing a portion of relatively low debondability and thus relatively high anchoring capacity at the innermost end of the bolt could supplement the anchoring effect of the drill bit or could provide some "fall back" anchoring should the drill bit fall off during the drilling process. Providing such a portion elsewhere on the bolt could provide supplemental anchoring to highly fractured rock.

The local anchor may provide an anchoring force that exceeds the yield load of bolt, which typically is the same as the yield load of the shank segments. For example, depending on the steel employed for the bolt, the inner diameter, and possibly other factors, a 32 mm OD shank segment exhibits a typical yield load between 200 and 300 kN. The anchoring force should exceed that yield load.

In order to provide true local anchoring, the aggregate axial length of the anchors, that is the sum of the axial lengths of the individual anchors, should be considerably less than the aggregate length of the bolt. The ratio of the axial length of the local anchors to the total length of the bolt may range from 1:2 to 1:50, and more typically of about 1:10 to 1:25.

The local anchors may advantageously be hardened so as to prevent from being deformed while being loaded while fixed in the hardened grout, and to prevent them from being ground down if they slide in the hardened grout. The local anchors may also be threaded on exterior surface, both to increase the anchoring effect and to enable mounting of a threaded nut at the rock face end of the bolt that secures a face plate or the like in place.

In each of the embodiments described below, the bolt includes a hollow metal tube with a drill bit threaded or otherwise mounted directly onto the bolt at its inner end. The drill bit or may act as an anchor, and a nut/plate assembly on the rock surface and the associated threads may also act as an anchor. At least one discrete intermediate local anchor is provided between the drill bit and the nut/plate assembly, and anchors may also be provided on each end of the bolt. Relatively elongateable shanks sections are provided between the local anchors. The shank sections preferably have a higher debondability and thus a lower anchoring capacity than the local anchors. The grouting takes place after the entire bolt, which may be comprised of several bolt sections, is installed in the borehole. The grout is injected or pumped through the axial bore in the tube, out of passages in the tube and/or the drill bit, and around the length of the tube. Upon hardening of the grout, the bolt can locally deform to absorb energy during rock deformation, but offers all of the advantages of a self-drilling hollow rock bolt, most notably negating the need to drill a borehole in potentially relatively unstable rock, then insert a separate bolt in the borehole, and then grout the bolt in place.

Turning now to FIG. 1, a multi-section hollow, self-drilling, locally anchored rock bolt 10 is illustrated. Bolt 10 includes a tube 12 formed from a number of tubular segments or bodies 14A-14D, some of which are connected end-to-end by couplers 16A-16C, a drill bit 18 provided on an inner end of innermost tubular body 14A, and a nut/plate assembly 20 provided an outer end of the outermost tubular body 14D. All of these components may be made of a carbon steel such as a high-carbon steel. Examples of possible alloys include 20 Cr or ASTM CK-20. Other metals that are both strong and deformable may be used. The drill bit 18 and coupler(s) 16A-16C all act as discrete local anchors. The thread-plate assembly 20 and the portion of the associated threads on which that assembly 20 is mounted and which is embedded in grout form a fifth discrete local anchor. The smooth portion of each tubular body 14A-14D between the threads forms a shank segment 22A-22D. A bore 24 extends axially through the tube 12 from its inner to outer ends for the flow of grout during an installation procedure.

Each shank segment 22A-22D has much lower anchoring ability or, stated another way, a higher debondability, than the anchors 16A-16C, 18, and 20. These segments 22A-22D may be smooth to the extent that they lack threads or other external protrusions or indentations. They also may be polished to further reduce their fiction. For example, each shank segment 22A-22D may be more or less finely ground or polished by techniques such as chemical polishing or electropolishing. The surface may further be treated in such a way that the surface of the shank segment has no or negligibly low bonding to the hardened grout. One technique for achieving this goal is to coat the shank segment surface with a thin layer of wax, lacquer, paint or other non-adhesive or lubricant medium. The shank segments also could be surface-treated to reduce their binding affinity for the hardened grout. For example, a metal oxide layer could be deposited on the shank segments. Alternatively, a portion or all of one or more of the shank segments could have limited anchoring capacity that exceeds that of a smooth portion but that is substantially lower than that provided by the local anchors. A tubular body having such an anchoring capacity is discussed below in conjunction with FIG. 9.

The bolt 10 of this embodiment is about 3.5 meters long, and has four tubular bolt segments or bodies 14A-14D, each of which is externally threaded at both ends. The threads on at least the outer end of the outermost tubular body 14D, and preferably all threads, should be at least as strong as the steel tube or even stronger. Therefore, the nominal diameter of the threads should be larger than the diameter of the remainder of the tubular body so that the effective diameter of the threads is equal to or larger than the diameter of the adjacent shank segment. It is also possible to conduct special metallurgical treatment to each threaded portion, included the work hardening process that occurs during roll-threading, so that its strength is made higher than the adjacent shank segment. The deformation capacity of the threads per se is not particularly relevant. It is, however, desirable that the threads have a chance to get into yielding. This increases the ultimate deformation of the shank segment prior to failure.

The three innermost tubular bodies 14A-14C of this embodiment are of the same or similar length, and the fourth, outermost tubular body 14D is considerably shorter. It should be emphasized that more or fewer tubular bodies could be provided in any particular installation, permitting anchoring in borehole depths of a variety of multiples of the length of each tubular body. Hence, the bolt 10 could be used in a 4.5 meter deep borehole simply by adding another tubular body to the tube 12 between, for example, tubular bodies 14C and 14D. Alternatively, bolt 10 could be used in a 2.5 meter deep borehole simply by removing a tubular body such as tubular body 14B from the tube 12. The lengths of each tubular body 14A-14D and thus the length of each shank segment 22A-22B and/or the lengths of the local anchors 16A-16C, 18, and 20 could vary considerably based on designer preference and on the intended application, so long as the aggregate length of the local anchors is of relatively short extent when compared to the aggregate length of the bolt 10. In the illustrated embodiment, the aggregate axial length of the local anchors, including the couplers 16A-16C, the drill bit 18, and the portion of threaded outer end of the bolt that is imbedded in the grout, is about 250 mm. This results in a ratio of anchor length to bolt length of about 1:14. Ratios between 1:10 and 1:25, and even between 1:2 and 1:50, would be well within the scope of the invention. The length of each intermediate coupler 16A-16C of this embodiment is about 50 mm, and the length of each of the three innermost shank segments 22A-22C is about 950 mm, resulting in ratio of the length of each of the coupler 16A and 16B to either of the two adjacent shank segments of 1:19. Ratios between 1:10 and 1:30 and even between 1:2 and 1:50, would be well within the scope of the invention.

Figure 2:
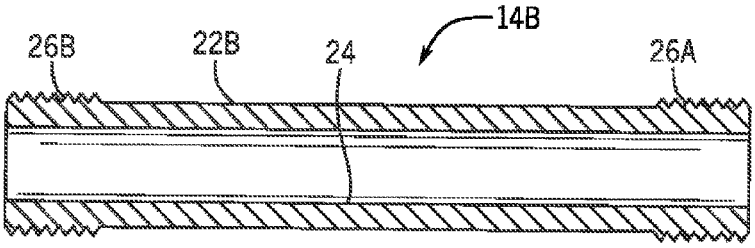
FIG. 2 is a somewhat schematic sectional side view of a tubular body of the rock bolt of FIG. 1.

Referring to FIG. 2, one of the tubular bodies is 14B illustrated, it being understood that the description applies equally to the tubular bodies 14A and 14C and that the tubular body 14D differs from the tubular bodies 14A-14C only in that it is shorter and may have a longer threaded section on its outer end. The tubular body 14B of this embodiment is a cylindrical tubular element having an outer diameter of 25 mm to 40 mm and an inner bore diameter that is typically about ⅗ of the shank segment diameter or about 15 mm to 24 mm. These diameters and proportions could vary significantly with designer preference and intended application. Threaded portions 26A and 26B are provided on the opposed ends of the tubular body 14B to define the shank segment 22B therebetween. Each threaded portion 26A and 26B should be about half as long as the corresponding coupler 16A, 16B described below. In the illustrated embodiment, each threaded portion 26A and 26B is 10 mm to 20 mm long, though considerably longer and shorter lengths fall within the scope of the invention.

Figure 3:
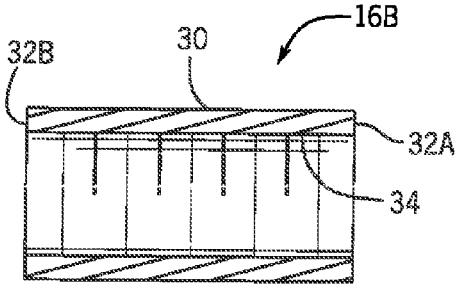
FIG. 3 is a sectional side view of a coupler of the rock bolt of FIG. 1.

One of the couplers 16B is illustrated in FIG. 3, it being understood that the description applies equally to couplers 16A and 16C. Coupler 16B takes the form of a hardened cylindrical steel sleeve having an outer surface 30, opposed ends 32A and 32B, and an axial through-bore 34. The outer surface 30 may be threaded in order to increase the anchoring capacity of the coupler 16B and to receive a nut if the coupler is disposed outwardly of the rock wall surface. The through-bore 34 is internally threaded so as to be screwable onto threaded ends of two adjacent tubular bodies 14B and 14C. Sleeve 16B may have a length of 20 mm to 40 mm, though significantly longer and shorter sleeves also would fall within the scope of the invention, so long as the sleeve 16B offers sufficient strength and gripping capacity to serve as a local anchor. Its inner diameter matches the outer diameter of the associated tubular bodies 14B and 14C, or 25 mm to 40 mm in this embodiment. The outer diameter may be, for example, 1.3 to 2.0 times the inner diameter, and more typically about 1.5 times the inner diameter or about 37 mm to 60 mm in this embodiment.

Figure 4:
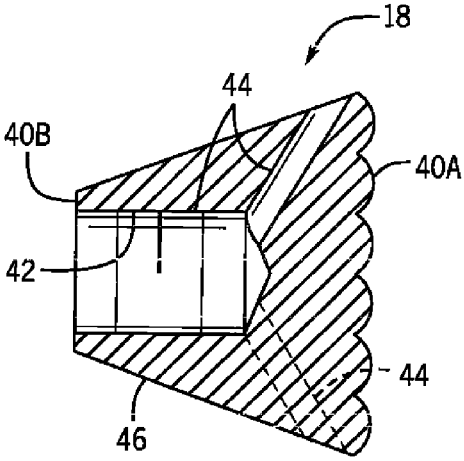
FIG. 4 is a somewhat schematic sectional side view of a drill bit or drill bit unit of the rock bolt of FIG. 1.

Referring to FIGS. 1 and 4, the drill bit 18 of this embodiment is a hardened steel element having inner and outer ends 40A and 40B and an internally threaded bore 42 extending inwardly from its outer axial end 40B. This bore 42 is threaded onto the external threads on the inner end of the innermost tubular body 14A. One or more passages 44 extends generally radially outwardly from the inner end of the bore 42 to an outer surface 46 of the drill bit 18 to permit grout that is pumped into the bore 24 of tube 12 from the outer end to flow through the bore 42 in the drill bit 18, outwardly through the passages 44, and, ultimately, axially outwardly along the length of the bolt 10 to fill the borehole. Other grout discharge passages (not shown), may be provided at other axial locations along the length of the tube 12, if desired. For example, one or more of the couplers 16A-16C could be provided with passages for the flow out of grout of the internal bore of the tube 12.

Still referring to FIGS. 1 and 4, the drill bit 18 may be generally frusto-conical in transverse cross section so as to have a diameter at its inner 40A end that is about 1.2 to 2.0, and more typically about 1.4, times the diameter at its outer end 40B. In this particular embodiment in which it is threaded onto the end of a 25 to 40 mm diameter shank, the drill bit 18 decreases in diameter from about 40 mm to 130 mm at is inner end 40A to about 27 mm to about 90 mm at its outer end 40B.

Referring again to FIG. 1, the washer, sheave, and/or face plate assembly 20 is located at the outer or head end of the bolt 10. It includes one or more of washer, sheave, and a face plate 52 clamped against the rock surface by a nut 50 threaded onto the outer end of the outermost tubular body 14D of tube 12. As mentioned above, the portion of the threads on the outer end of the tubular body 14D that are embedded in the grout can be considered part of the local anchor formed by assembly 20.

Figure 5:
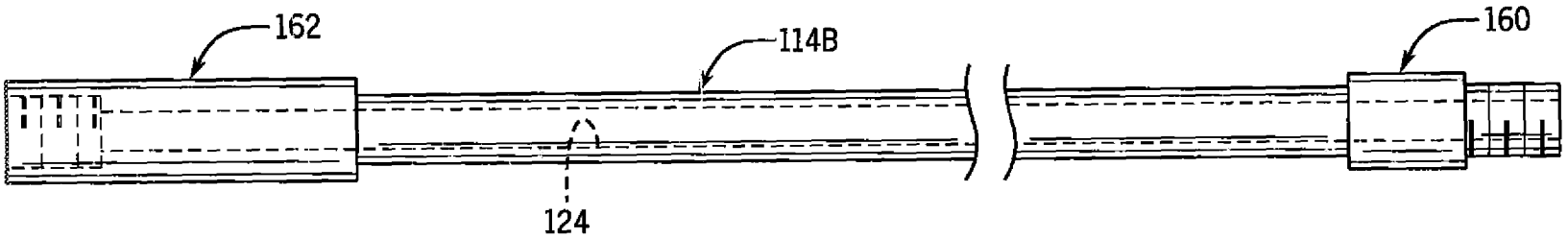
FIGS. 5 and 5A are side views of portions of a self-drilling, hollow, locally-anchored, deformable rock bolt constructed in accordance with yet another embodiment of the invention.
Figure 5A:
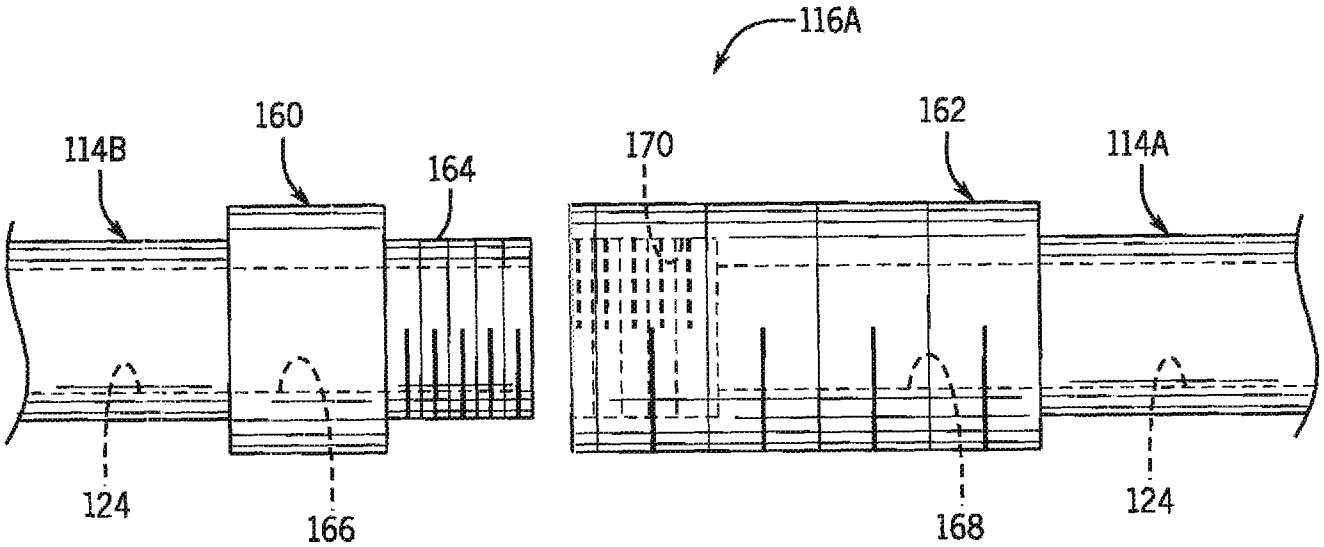

It should be noted that one or more of the couplers could be mounted on the tubular bodies 14A-14D other than solely by threading. For example, referring to FIGS. 5 and 5A, an alternative two-piece coupler is shown for coupling two tubular bodies together. Each coupler 116A, 116B, etc. of this embodiment includes first and second, male and female, sections 160 and 162. Both sections 160 and 162 of two couplers 116 A, 116B on the opposed ends of the same tubular body 114B are shown in FIG. 5, and two mating sections 160 and 162 of the same coupler 116A are shown in FIG. 5A. Referring especially to FIG. 5B, coupler section 160 has an externally threaded male protrusion 164 and an internal bore 166 that is of the same diameter as the bore 124 in the associated tubular body 114B. Coupler section 162 has a stepped internal bore including a relatively small diameter inner section 168 of the same diameter as the diameter of the bore 124 in tubular body 114A, and a threaded relatively large diameter outer section 170 that receives the male protrusion 164 of coupler section 160. The relatively large diameter threaded portions 164 and 170 provide a more secure connection than is provided by the smaller-diameter threaded portions of the embodiment of FIGS. 1-4. Instead of being threaded onto the associated tubular body, one end 172 or 174 of each coupler section 160 or 162 is welded to the end of the associated tubular body 114B or 114A, such as by friction welding, so that the internal bores 166 and 168 align with the bores in the tubular bodies 114A and 114B. The assembled coupler 116A may have a length of about 250 mm and an outer diameter of about 40 mm. As with the other embodiments discussed herein, these dimensions may vary significantly.

One or more of the intermediate anchors could take the form of anchors other than couplers connecting individual tubular bodies together, negating the need for a multi-section bolt at the cost of reduced borehole length design versatility and/or increased bolt inventory. One or more of these other types of local anchors also could be provided between existing coupler locations. These other types of local anchors could take any of a variety of forms, and different types of anchors could be provided on the same bolt.

Figure 6A:
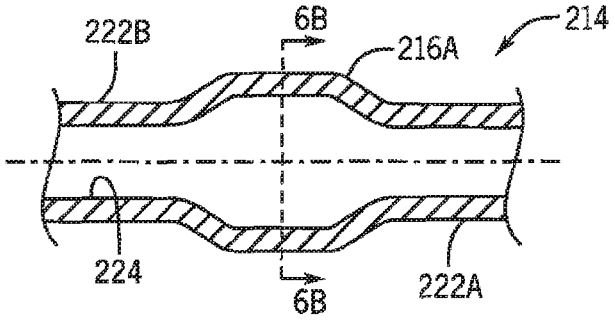
FIGS. 6A and 6B are a sectional side view and a sectional end view, respectively, of an alternative intermediate anchor of a rock bolt constructed in accordance with the invention.
Figure 6B:
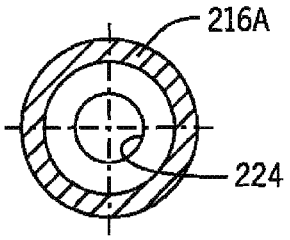

For example, one or more of the intermediate anchors could be formed simply by crimping or otherwise shaping a section of the tube. For example, an intermediate anchor 216A could be formed by expanding a section of a tubular body 214 as shown in FIGS. 6A and 6B, resulting in an anchor that is wider in all directions than the adjacent portions of the tubular body 214 forming consecutive shank segments 222A and 22B adjacent each end of the anchor 216A. Significantly, the diameter of the bore 224 is not adversely affected by this expansion.

Figure 7A:
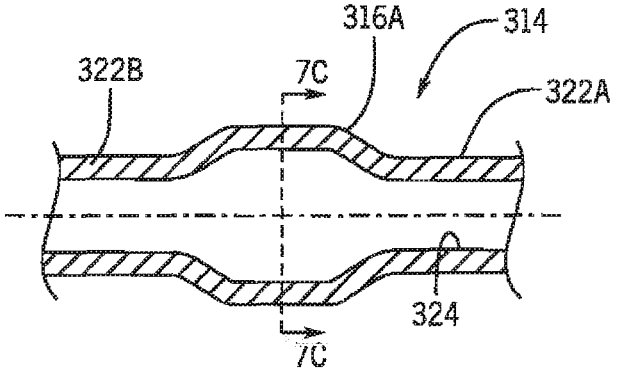
FIGS. 7A-7C are a sectional side view, a sectional plan view, and a sectional end view, respectively, of another alternative intermediate anchor of a rock bolt constructed in accordance with the invention.
Figure 7C:
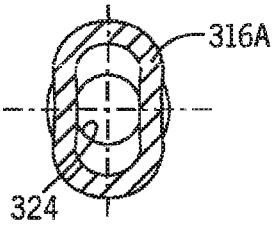
Figure 7B:
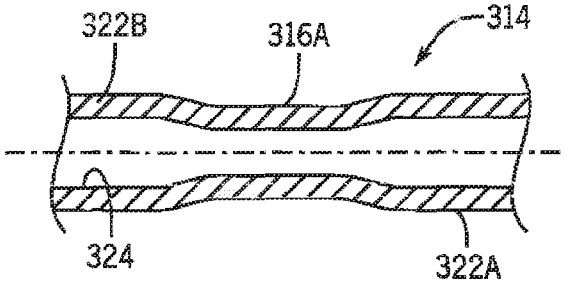

Alternately, one or more intermediate anchors could be formed by flattening the tubular body in one direction and enlarging the direction orthogonal to that direction. Such an anchor 316A is shown in FIG. 7A-7C as being formed in tubular body 314, forming a shank segment 322A, 322B adjacent each end of anchor 316A. Note that the tubular body 314 is expanded in plan as seen in FIG. 7A but flattened in elevation as seen in FIG. 7B. Referring to FIG. 7C. Care should be taken when flattening the tubular body 314 so as to not collapse the bore 324 so much as to hinder the flow of grout through the bore 324.

Figure 8A:
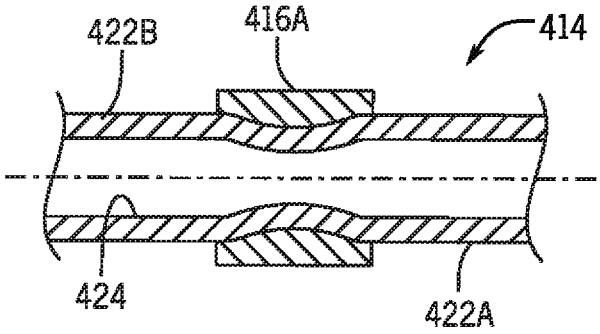
FIGS. 8A and 8B are a sectional side view and a sectional end view, respectively, of yet another alternative intermediate anchor of a rock bolt constructed in accordance with the invention.
Figure 8B:
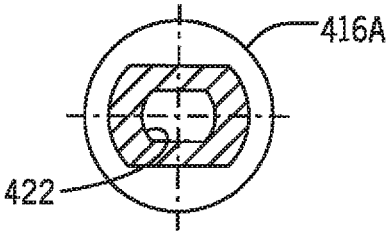

As still another example, one or more of the intermediate anchors could take the form of an external anchor. Such an anchor is shown in FIGS. 8A and 8B in the form of a swaged anchor 416A clamped onto a crimped section of the tubular body 414, forming shank segments 422A and 422B adjacent each end of anchor 416A. Again, the bore 424 is not collapsed sufficiently upon crimping of the tubular body 414 to hinder the flow of grout therethrough.

As mentioned above, the shank segment of a particular tubular body need not be smooth along its entire length. It instead may be desirable and even preferable to imbue part or all of the shank segment with limited anchoring capacity, albeit less than that provided by the local anchors. Most typically, this type of shank segment will exhibit non-uniform debondability, and thus non-uniform anchoring capacity, along its axial length.

Figure 9:
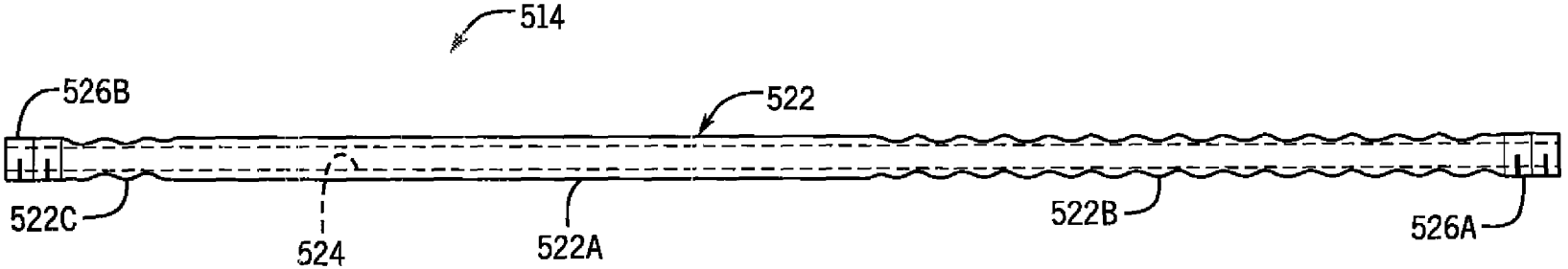
FIG. 9 is a sectional side view of a segment of a self-drilling, hollow, locally-anchored, deformable rock bolt constructed in accordance with another embodiment of the invention.

One such tubular body 514 is illustrated in FIG. 9. Tubular body 514 threaded portions 526A and 526B on the opposed ends of the tubular body 14B to define a shank segment 522 therebetween. The tubular body 514 of this embodiment is a cylindrical tubular element having an outer diameter of 25 mm to 40 mm and an inner bore diameter that is typically about ⅗ of the shank segment diameter or about 15 mm to 24 mm. As with the previous versions, these diameters could vary significantly with designer preference and intended application. Tubular body 514 is relatively long when compared to the tubular bodies illustrated in FIG. 1, having a typical shank segment length of about 2,000 to 3,500 mm, more typically of 2,500 to 2,800 mm, and most typically of about 2,700 mm, which is the length of the illustrated shank segment 522. Each threaded portion 226A and 226B should be about half as long as the corresponding coupler 16A, 16B described above. In the illustrated embodiment, each threaded portion 526A and 526B is 10 mm to 20 mm long, though considerably longer and shorter lengths fall within the scope of the invention.

The shank segment 522 is of non-uniform debondability along its length. That is, at least one portion of the shank segment 522 is imbued with lower debondability and resultant higher anchoring capacity than one or more other portions of the segments in order, for example, to supplement the anchoring effect of existing local anchors, to act as a fallback in the event of the absence of a local anchor, and/or to provide supplemental anchoring to highly fractured rock. The shank segment 522 of this embodiment has three portions of differing debondability. An intermediate portion 522A of maximum debondability, and thus having minimal anchoring capacity, is disposed between two portions 522B and 522C that have reduced debondability, and thus increased anchoring capacity, when compared to portion 522A. Each portion 522B and 522C is threaded, knurled, bent into a waveform, and/or otherwise provided with or bear structures imbuing greater anchoring capacity in that portion than in the smooth portion 522A. Portions 522B and 522C are bent into waveforms in this particular example. In this exemplary embodiment in which the body 514 is slated to bear a drill bit on its inner threaded portion, inner portion 522B is designed to have significant anchoring capacity (though far less than that of the local anchors described above) in order to supplement the anchoring effect of the drill bit or to provide some "fall back" anchoring should the drill bit fall off during the drilling process. Portion 522B therefore extends a significant portion of the length of the shank segment 522. In the illustrated example in which the shank segment 522 is 2,700 mm long, the portion 522B may have a typical length of 1,000 mm to 2,000 mm and more typically of about 1,300 mm. The outer portion 522C of shank segment 522 is provided to supplement the anchoring effect of the coupler that is to be mounted onto the threaded inner end 526B of tubular body 514. It is therefore relative short when compared to portion 522B, namely on the order of 200 mm to 400 mm and specifically 300 mm in this embodiment. The intermediate portion 522A takes up the remainder of the length of the shank segment 522 or 1,100 mm in the illustrated embodiment.

It must be stressed that the styles, number, and extent of portions of differing debondability that fall within the present invention are virtually limitless.

Figure 10:
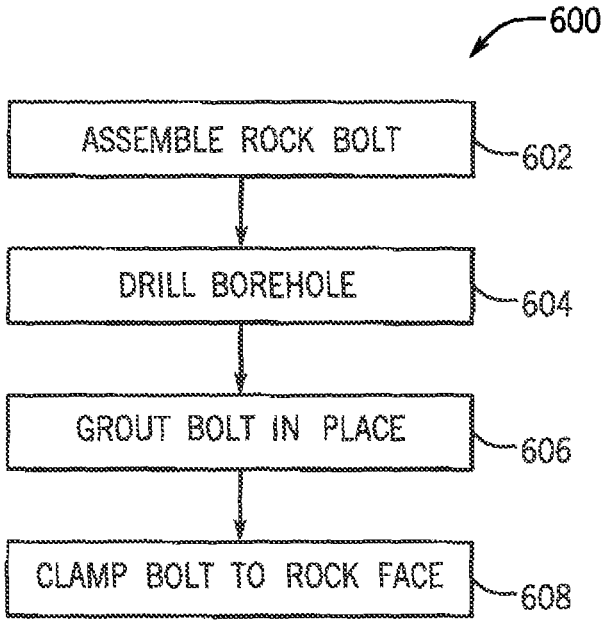
FIG. 10 is a simple flowchart of a process for mounting a rock bolt in a borehole.

Multi-section rock bolts constructed as described above, or other rock bolts constructed in accordance with the invention, could be installed using the process 600 schematically illustrated by FIG. 10. This process will described in conjunction with the rock bolt 10 of FIGS. 1-4, it being understood that the description is equally applicable to rock bolts having the couplers illustrated in FIGS. 5A-5B, intermediate anchors of any or all of the types illustrated in FIGS. 6A-8B, tubular bodies as illustrated in FIG. 9, or any other multi-section rock bolt falling within the scope of the present invention.

Process 600 begins with block 602, where the rock bolt 10 is assembled by attaching the drill bit 18 to the inner end of a first tubular body 14A of the tube 12, and the bolt 10 may be assembled to the desired length by connecting at least one additional tubular body to that body 14A via a coupler 16A. The second tubular body may be a relatively short body corresponding to the outermost tubular body 14D of FIG. 1, or could be of the same length or longer than the length of the first tubular body 14A. Additional tubular bodies may be added in the same manner, resulting in a bolt having N shank segments, each of which is provided on a respective tubular body, and M intermediate couplers between the drill bit and the outer end of the bolt, where N is at least 2 and M is at least 1. The intermediate coupler(s) also could be connected to the adjacent tubular bodies via welding as discussed above in connection with FIGS. 5 and 5A above or via another technique entirely, and/or the bolt 10 could be provided with one or more other types of intermediate anchors such as one or more of those discussed above in connection with FIGS. 6A-8B. Sections of bolts may typically also be assembled after a previous section of the bolt has been drilled (see next paragraph). This may be necessary or desirable, e.g., in cases where the tunnel profile restricts the lengths of the bolt used, or in cases where shorter sections of the bolt are easier to drill.

The outer end of the bolt 10 or a bolt section is then attached to a drill, and the bolt or a bolt section is then drilled into a rock surface in block 604 to form a borehole with the bolt 10 inserted into it with the bit 18 at the inner end of the borehole and the outer end of the bolt 10 protruding from the outer end of the borehole. If additional sections of the bolt are required, these additional sections are assembled onto the previous sections through the use of the coupler/anchor sections, and the drilling process is repeated until all the sections have been assembled and drilled. Water may be pumped through the hollow bore 24 of the tube 12 and out of the outer end of the borehole during and/or after the drilling process to flush drill cuttings from the borehole. The bolt 10 is now inserted into a borehole having a diameter approximately equal to that of the largest diameter of the drill bit 18. The borehole is sufficiently wide to provide a clearance between the bolt, including the relatively wide couplers 16A-16C, and the periphery of the borehole of sufficient diameter to permit grout to flow between the bolt 10 and the periphery of the borehole along the entire length of the bolt 10.

Next, in block 606, the bolt 10 is grouted in place without removing the bolt from the borehole. The grout may be any grout used in the mining or tunneling industries. It may, for example, be a cementitious material or a multi-component resin such as two-part epoxy resin, mixed before entering the tube 12. The grout is injected, pumped, or otherwise supplied into the hollow bore 24 of tube 12 from its open outer end and flows axially through the hollow bore 24, out of the inner end of the innermost tubular body 14A, out of the passages 44 in the drill bit 18, and then into the borehole adjacent the inner end of bolt 10. The grout then flows outwardly through the borehole so as to fill the gap between the bolt and the periphery of the borehole. If needed or desired, a standard coned sleeve may be placed around the bolt near the face end of the borehole to prevent grout from pouring out of the borehole and thus ensure more complete grouting. If the grout is a multi-component resin, resin mixing can be enhanced by turning the bolt in the borehole during this process. Because the rock bolt 10 remains within the borehole, the chances of borehole collapse are eliminated or at least sharply reduced. This will prevent or at least inhibit debris from blocking the flow of grout through the gap between the bolt 10 and the periphery of the borehole and along the depth of the borehole. The bolt 10 is grouted in place after the grout hardens. The bolt 10 now is locally anchored to the rock at the locations of the discrete local anchors formed by the drill bit 18 and the intermediate anchor(s) 16A, 16B, etc. as well as the threads on the outer end of the outermost tubular body 14D.

The nut and washer, sheave, or face plate assembly 60 is then threaded onto the rock and in place near block 608 using the threads on the outer end of the tubular body 14D, or alternatively the threads on the outermost coupler, as in coupler 116A'.

The resulting rock bolt has at least two smooth shank segments and at least two discrete local anchors, with at least one of the anchors being an intermediate anchor flanked by two shank segments. Thus, the rock bolt will be attached firmly to the rock at a multiplicity of spaced borehole locations along the length of the bolt and constrain rock deformation. Pre-tensioning of the bolt may prevent or delay initial crack formation and may also provide an earlier constraining of the rock mantle. The rock bolt will be useful for constraining rock deformation both due to both long-term deformation and rock burst.

Figure 11:
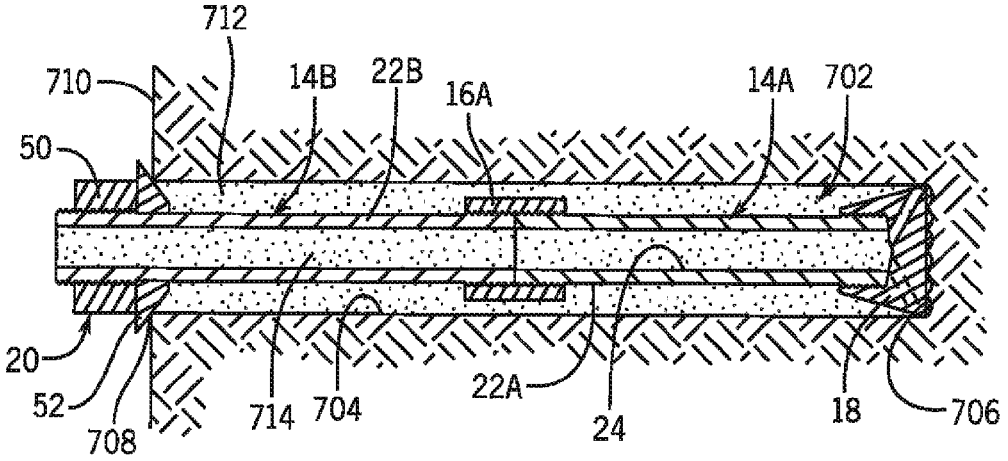
FIG. 11 is a sectional side elevation view showing a rock bolt of the type illustrated in FIGS. 1-4, installed in a borehole and grouted in place.

The installed bolt 10 is shown as anchored within a borehole 702 in a wall 700 in FIG. 11. The borehole 702 has a peripheral surface 704, an inner end 706, and an outer opening 708 in a surface 710 of the wall 700. As described above, the bit 18, having drilled the borehole 702, is positioned at the inner end 706. The bolt 10 extends the length of the borehole 702 with the nut/plate assembly 20 positioned outwardly of the outer opening 708 so as to clamp the bolt 10 against the surface 710. An annular gap 712 is formed between the outer radial periphery of the bolt 10 and the outer peripheral surface 704 of the borehole 702. The inner bore 24 and the annular gap 712 are filled with grout 714. The bolt 10 is anchored in the borehole by the nut/plate assembly 20 and by local anchors including the bit 18 and the intermediate anchor 16A, both of which are partially or fully embedded in the grout 714. If the borehole 702 were deeper, the effective length of the bolt 10 could have been increased by adding additional threaded portion(s) such as 14C and 14D and additional coupler(s) such as 16B and 16C. The additional coupler(s) would form additional local anchor(s).

Figure 12:
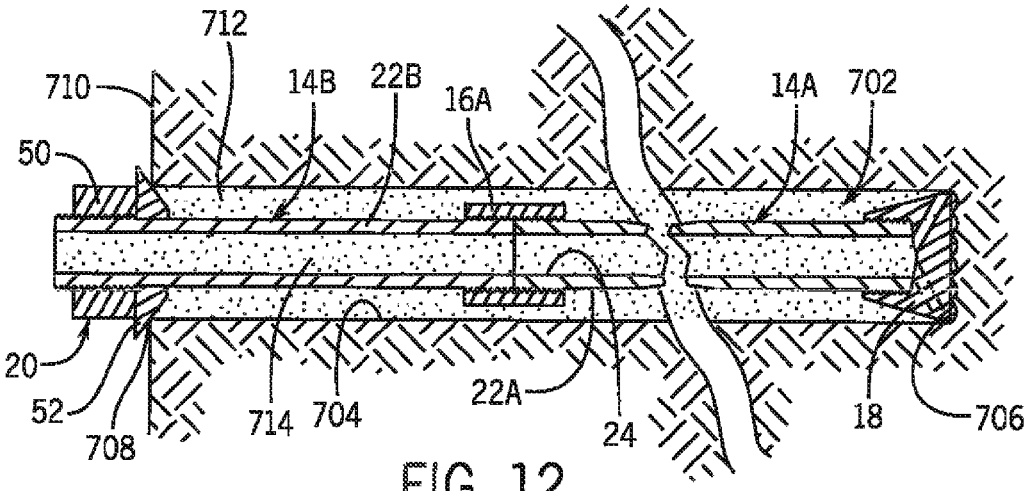
FIG. 12 corresponds to FIG. 11 but shows deformation of the rock bolt due to rock fracture.

Post-bolt installation rock deformation will primarily load the bolt 10 through the anchors 18, 16A, and 20. The shank segments 22A and 22B between each pair of adjacent anchors, in turn, will be stretched and elongated. Under extremely high loads, one or more of the shank segments 22A, 22B will yield. Such an event is shown in FIG. 12 with the yielding of shank segment 22A. In this case, reinforcement is still provided by the intermediate anchor 17A and shank segment 22B.

In some cases, for instance in conjunction with a relatively weak grout, the anchors could even slide a bit within the grout without a significant loss of reinforcement. Because of these two mechanisms, the bolt 10 and other bolts constructed in accordance with the invention can tolerate a large elongation on the order of more than 10% to more than 15% over a 100 mm sample length, and even more than 20% over a 100 mm sample length, depending on the characteristics of the material, while at the same time bearing a load equivalent to the yield load of the bolt. In fact, bolt 10 and other bolts constructed in accordance with the invention utilize the capacity of the steel material in both its deformation capacity and strength. If the bolt has two or more anchors including at least one intermediate anchor between the drill bit and the outer plate, the rock anchoring effect of the bolt is assured within segments between the anchors. A loss of anchoring at an individual anchor only locally affects the reinforcement effect of the bolt. On the whole, the bolt would still work well with a loss of one or more individual local anchors, as long as one or more anchors are fixed in the borehole.

Although the best modes contemplated by the inventor of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

We claim:

1. A locally-anchored, self-drilling, deformable, hollow rock bolt for being grouted in a borehole in a rock, said rock bolt comprising:

a hollow elongated tube having inner and outer ends and having an axial bore, the inner end of the hollow tube being configured to bear a drill bit;

at least one passage configured to permit grout to flow from the axial bore and past an outer peripheral surface of the rock bolt; and axially spaced local anchors including at least one intermediate anchor provided axially between the drill bit and the outer end of the tube and flanked by two adjacent relatively deformable metal shank segments, an aggregate axial length of the local anchors being of short axial extent when compared to an axial length of the rock bolt, wherein each of the shank segments has a relatively low anchoring capacity when compared to an anchoring capacity of the local anchors so that each of said shank segments constrains local rock deformation through elongation of that shank segment, wherein the local anchors and the shank segments are configured such that the bolt can tolerate an elongation on the order of more than 10% over a 100 mm long section of the bolt while bearing a load equivalent to the yield load of the bolt.

2. The rock bolt as recited in claim 1, wherein the drill bit forms a local anchor.

3. The rock bolt as recited in claim 1, wherein the rock bolt has at least two intermediate local anchors and at least three shank segments.

4. The rock bolt as recited in claim 1, wherein a ratio of aggregate local anchor length to bolt length is between 1:2 and 1:50.

5. The rock bolt as recited in claim 4, wherein the ratio of aggregate local anchor length to bolt length is between 1:10 and 1:25.

6. The rock bolt as recited in claim 1, wherein the local anchors and the shank segments are configured such that the bolt can tolerate an elongation on the order of more than 20% over a 100-mm long section of the bolt while bearing a load equivalent to the yield load of the bolt.

7. The rock bolt as recited in claim 1, wherein at least one of the intermediate local anchors comprises a coupler connecting two adjacent shank segments of the tube together.

8. The rock bolt as recited in claim 7, wherein the coupler is mounted on the two adjacent shank segments by one of threading and welding.

9. The rock bolt as recited in claim 1, wherein at least one of the intermediate local anchors is formed by one of shaping a section of the bolt and attaching an external anchor to the bolt.

10. The rock bolt as recited in claim 1, wherein at least one of the shank segments is of essentially uniform debondability along at least substantially an entire axial length thereof.

11. The rock bolt of claim 1, wherein an outer peripheral surface of at least one shank segment is sufficiently smooth along at least substantially the entire axial length thereof so as to have no more than negligible bondability to the grout.

12. The rock bolt as recited in claim 1, wherein at least one of the shank segments is of non-uniform debondability along an axial length thereof, having axial portions of distinctly different debondability from one another.

13. The rock bolt as recited in claim 12, wherein at least one of the shank segments has at least one smooth section and at least one section that is at least one of threaded, knurled, and bent.

14. The rock bolt as recited in claim 1, wherein the local anchors are of a greater diameter than the shank segments.

15. A locally-anchored, self-drilling, deformable, hollow rock bolt for being grouted in a borehole in a rock, said rock bolt comprising:

a hollow elongated tube having inner and outer ends and an axial bore, the tube being formed from N axially aligned tubular bodies, where N is at least 2, at least one passage being formed in the rock bolt to permit grout to flow from the axial bore and past an outer peripheral surface of the rock bolt;

a drill bit provided on the inner end of the tube and forming a local anchor;

M intermediate couplers, where M is at least 1, which are provided between the drill bit and the outer end of the tube, each of which connects two adjacent tubular bodies together and defines a local anchor that separates two consecutive elongatable shank segments, wherein each of the intermediate couplers forms a local anchor and is of a greater outer diameter than an outer diameter of the tube, wherein an aggregate axial length of the local anchors is of short axial extent when compared to an axial length of the rock bolt, wherein each of the shank segments is formed from a carbon steel and has a relatively low anchoring capacity when compared to an anchoring capacity of the local anchors so that each of said shank segments constrains local rock deformation through elongation of that shank segment, wherein an outer peripheral surface each of the shank segments is sufficiently smooth along at least substantially the entire axial length thereof so as to have no more than negligible bondability to the grout, and wherein the local anchors and the shank segments are configured such that the bolt can tolerate an elongation on the order of more than 10% over a 100-mm long section of the bolt while bearing a load equivalent to the yield load of the bolt.

16. The rock bolt as recited in claim 15, wherein the bolt has at least two intermediate couplers and at least three shank segments.

17. A method comprising:

drilling a borehole using a locally-anchored, self-drilling, locally deformable, hollow rock bolt, the rock bolt having a hollow elongated tube having inner and outer ends and having an axial bore, a drill bit provided on the inner end of the tube, and local anchors including at least one intermediate local anchor provided axially between the drill bit and the outer end of the tube and flanked by two adjacent relatively-elongatable metal shank segments of the tube, an aggregate axial length of the anchors being of short axial extent when compared to an axial length of the rock bolt; then while the rock bolt is in the borehole, supplying grout into the axial bore in the tube so that the grout flows from the axial bore and into a gap between an outer peripheral surface of the rock bolt and an outer peripheral surface of the borehole in a quantity that is sufficient to at least substantially fill the gap; then allowing the grout to harden such that the rock bolt is locally anchored to the grout at least two axially-spaced locations that are separated from one another by a shank segment, wherein the bolt is configured such that the bolt can tolerate an elongation on the order of more than 10% over a 100-mm long section of the bolt while bearing a load equivalent to the yield load of the bolt.

18. The method as recited in claim 17, further comprising coupling at least two of the shank segments of the tube together via a coupler prior to or between segments of the drilling step, and wherein the coupler forms an intermediate local anchor after the grout hardens.

19. The rock bolt as recited in claim 1, wherein each of the shank segments is formed from a carbon steel.

20. The method as recited in claim 17, wherein each of the shank segments is formed from a carbon steel.

21. A locally-anchored, self-drilling, deformable, hollow rock bolt for being grouted in a borehole in a rock, said rock bolt comprising:

a hollow elongated tube having inner and outer ends and having an axial bore, the inner end of the hollow tube being configured to bear a drill bit;

at least one passage configured to permit grout to flow from the axial bore and past an outer peripheral surface of the rock bolt; and axially spaced local anchors including at least one intermediate anchor provided axially between the drill bit and the outer end of the tube and flanked by two adjacent relatively deformable shank segments of the tube, an aggregate axial length of the local anchors being of short axial extent when compared to an axial length of the rock bolt, wherein each of the shank segments is formed of a metal and has a relatively low anchoring capacity when compared to an anchoring capacity of the local anchors so that each of said shank segments constrains local rock deformation through elongation of that shank segment, wherein the local anchors and the shank segments are configured such that the bolt can tolerate an elongation on the order of more than 10% over a 100-mm long section of the bolt.

22. The rock bolt as recited in claim 21, wherein each of the shank segments is formed from a carbon steel.

23. The rock bolt as recited in claim 21, wherein an outer peripheral surface of each of the shank segments is sufficiently smooth along at least substantially the entire axial length thereof so as to have no more than negligible bondability to the grout.

* * * * *